US006004103A

United States Patent [19]

Fisher et al.

[11] Patent Number: 6,004,103

[45] Date of Patent: Dec. 21, 1999

[54] AIR COMPRESSOR SYSTEM

[75] Inventors: Lynn Edwin Fisher; James V. Yu, both of Fort Wayne, Ind.

[73] Assignee: General Electric Company, Schnetady, N.Y.

[21] Appl. No.: 08/886,655

[22] Filed: Jul. 1, 1997

[51] Int. Cl.[6] ..... F04B 49/02

[52] U.S. Cl. ..... 417/26; 417/44.2; 417/415; 417/440

[58] Field of Search ..... 417/26, 27, 44.2, 417/388, 415, 440

[56] References Cited

U.S. PATENT DOCUMENTS

| | | | |
|---|---|---|---|
| 1,072,576 | 9/1913 | Conrader . | |
| 1,365,272 | 1/1921 | Reeder . | |
| 1,444,122 | 2/1923 | Hoffman . | |
| 1,454,402 | 5/1923 | Parsons . | |
| 1,461,379 | 7/1923 | Brewer . | |
| 1,475,757 | 11/1923 | Dyson . | |
| 1,543,680 | 6/1925 | Redfield . | |
| 1,602,938 | 10/1926 | Riesner . | |
| 1,627,376 | 5/1927 | Conrader . | |
| 1,884,702 | 10/1932 | Hubacker . | |
| 1,998,604 | 4/1935 | Belden . | |
| 2,107,644 | 2/1938 | Ohmart . | |
| 2,117,468 | 5/1938 | Wolcott . | |
| 2,199,415 | 5/1940 | Philipp . | |
| 2,321,151 | 6/1943 | McCormack . | |
| 2,329,401 | 9/1943 | Valley . | |
| 2,445,527 | 7/1948 | Hirsch . | |
| 2,462,232 | 2/1949 | Stein . | |
| 2,629,537 | 2/1953 | Graybrook et al. . | |
| 3,875,358 | 4/1975 | Wilicox | 200/83 |
| 5,139,051 | 8/1992 | Walstad et al. | 137/630 |
| 5,162,718 | 11/1992 | Schroeder | 318/794 |

*Primary Examiner*—Charles G. Freay
*Assistant Examiner*—Ehud Gartenberg
*Attorney, Agent, or Firm*—Welsh & Katz, Ltd.; Carl B. Horton, Esq.; Wayne O. Traynham, Esq.

[57] ABSTRACT

An air compressor system having an actuator for controlling the energization of the primary and start windings of the compressor motor and the state of a relief valve is disclosed. No power is applied to either of the windings and said valve is closed when the actuator is disposed in the first position. Movement of the actuator to the second position energizes both of the windings and opens the relief valve so that the motor and compressor can reach full speed before a load is applied. When the actuator is released and moved to the third position, the start winding is deenergized and the relief valve is closed to allow an air storage tank to be filled.

15 Claims, 3 Drawing Sheets

AIR COMPRESSOR SYSTEM

FIELD OF THE INVENTION

The present invention relates generally to air compressor systems and, more particularly, to an inexpensive air compressor system for use in user attended applications which has a movable actuator for controlling the energization of the primary and start windings of the compressor motor and the state of an adjustable relief valve thereby allowing the storage tank to vent to atmosphere during motor start-up.

BACKGROUND OF THE INVENTION

Some air compressor systems in use today utilize an adjustable relief valve that allows a user to select a desired air pressure that is to be applied to an air storage tank. When the valve is disposed in a full open position, the electric motor and air compressor are not loaded because the high pressure air supplied to the tank is vented to atmosphere via the relief valve. The motor includes an on/off switch that allows the primary and start windings of the motor to be connected to an external AC power source. A centrifugal mechanism typically is mounted on the motor shaft to allow the start winding of the electric motor to be disconnected from the external power source when the motor reaches full speed.

An unloader valve may be utilized to temporarily allow the air that is compressing under normal start-up or steady state off conditions to vent directly to the atmosphere instead of into the storage tank. This reduces the load initially applied to the motor and air compressor thereby allowing smaller, less expensive motors to be used. The unloader valve may not always be closed at the same point in time during operation because, for example, the pressure of the compressed air supplied from the air compressor varies with temperature.

Air compressor systems such as those described above typically are utilized in user attended applications where the motor and compressor are run for relatively short periods of time and the storage tank is compressed to a relatively low pressure. The user sets the adjustable valve to the desired pressure, turns the motor and compressor on and waits for the air storage tank to fill to the desired pressure. When the desired pressure is reached, the user shuts the motor and compressor off. Automatic operation wherein a pre-selected storage tank pressure level is maintained is uncommon in these applications.

Constructing an air compressor system that is to be utilized in a user attended application as discussed above is expensive and decreases the manufacturer's profit margin for each system that is sold. For example, material costs are unnecessarily high because a number of different single-use components are utilized and labor costs are unnecessarily high due to the time required for assembling the various components of the air compressor system.

SUMMARY OF THE INVENTION

It is desirable to provide an air compressor system having a moveable actuator which allows a user to control the energization of the primary and start windings of the compressor motor and the state of an adjustable relief valve. The costs of manufacturing said air compressor system are significantly reduced over typical air compressor systems for a number of reasons. First, the use of the moveable actuator to control the energization of the motor windings eliminates the need to provide the motor with a centrifugal mechanism and a separate AC power switch. Second, the use of the moveable actuator to control the state of an adjustable relief valve allows the storage tank to vent to atmosphere during motor start-up thereby precluding the need to provide a separate unloader valve and pressure switch. Third, an inexpensive motor can be used because the actuator allows the motor to be unloaded prior to reaching full speed.

Other features and advantages of the invention will become apparent from the description that follows.

DETAILED DESCRIPTION OF THE INVENTION

Figure 1:
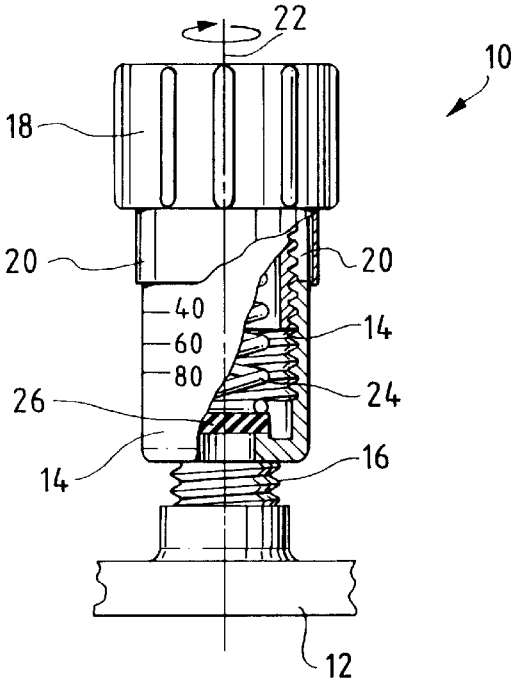
FIG. 1 PRIOR ART
FIG. 1 is a side view of a prior art adjustable pressure relief valve.

Referring now to FIG. 1, a typical adjustable valve 10 is shown. Valve 10 communicates with an air containing chamber such as, for example, storage tank 12 and allows a user to select a desired pressure to be placed in tank 12. Valve 10 includes a stationary body portion 14 which is secured to a threaded outlet 16 on tank 12 and has visual tank pressure level indications provided on its outer surface as shown. Knob 18 and integral flange 20 can be rotated about axis 22 and moved with respect to body portion 14 to set the desired pressure to be placed in tank 12 as discussed hereafter.

Flange 20 includes threads on its inner surface which mate with corresponding threads on an outer surface of the body portion 14. Thus, the rotation of knob 18 about axis 22 moves the flange 20 with respect to the pressure indications located on the outside of body portion 14 to allow the user selected pressure level to be indicated. Knob 18 includes a spring 24 which biases valve stem 26 to the closed position shown in FIG. 1. Rotation of knob 18 changes the compression of spring 24 to allow the pressure inside the tank 12 to vent to atmosphere at the pressure level indicated on body portion 14 by the flange 20.

Figure 2:
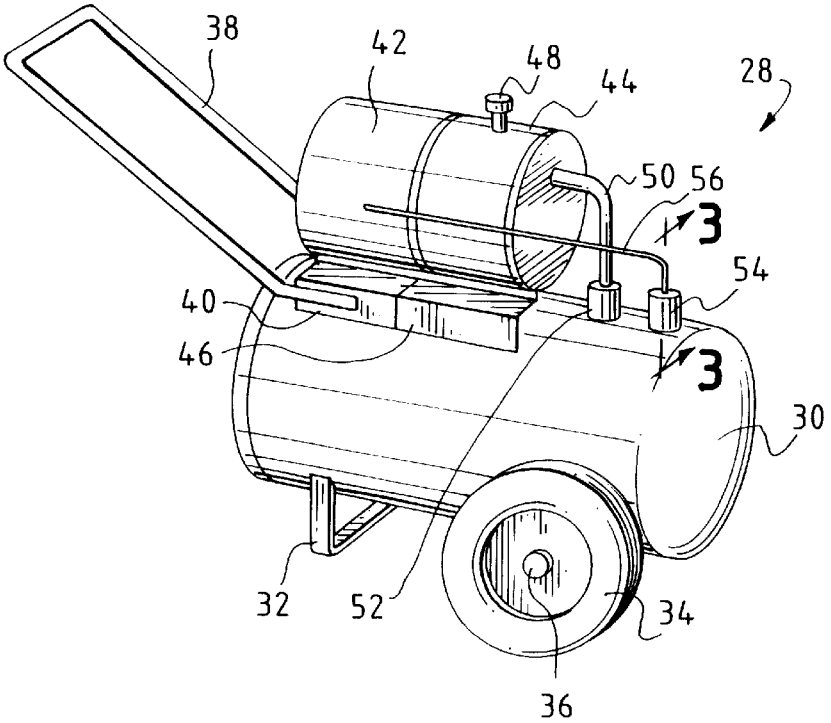
FIG. 2 is a perspective view of a portable air compressor system according to an embodiment of the present invention.

A perspective view of a portable air compressor system 28 according to an embodiment of the present invention is shown in FIG. 2. Air compressor system 28 includes an air storage tank 30 that is supported on a surface (not shown) by a support 32 and wheels 34 which are mounted on tank 30 via axle 36. A handle 38 is mounted on tank 30 via bracket 40 so that the air compressor system 28 can be moved.

An electric motor 42 and an air compressor 44 are mounted on tank 30 by brackets 40 and 46. Motor 42 is operatively engaged with compressor 44 via a motor shaft (not shown). Compressor 44 includes an air intake 48 and an outlet conduit 50 which communicates with tank 30 via check valve 52. Check valve 52 precludes the flow of high pressure air from tank 30 to the compressor 44 via conduit 50. A multi-use component 54 is electrically connected to the motor 42 via line 56 and communicates with the tank 30. Component 54 allows a user to control the energization of the primary and start windings of the compressor motor and the state of an adjustable relief valve as discussed hereafter.

Figure 3C:
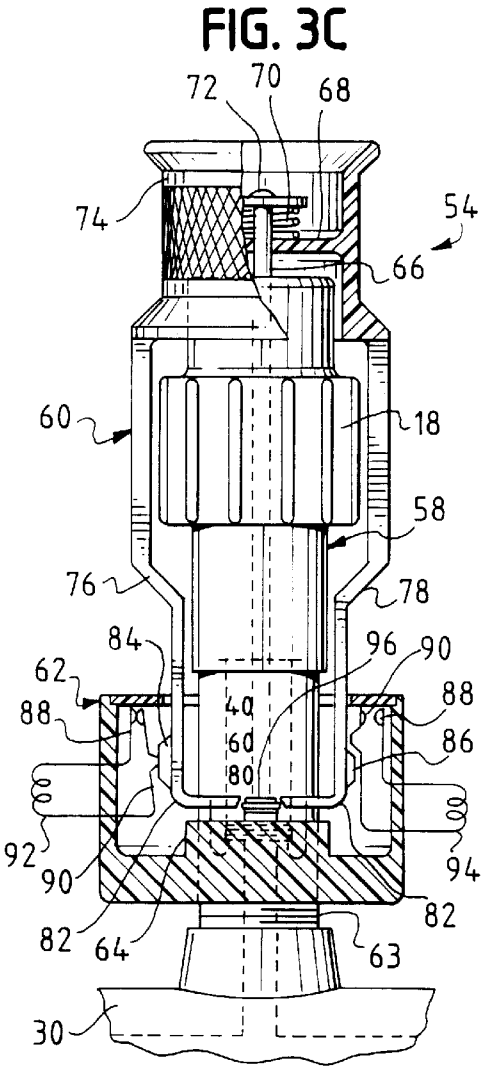
FIGS. 3A–3C are sectional views taken along lines 3—3 in FIG. 2 which illustrate the operation of the air compressor system shown in FIG. 2.
Figure 3B:
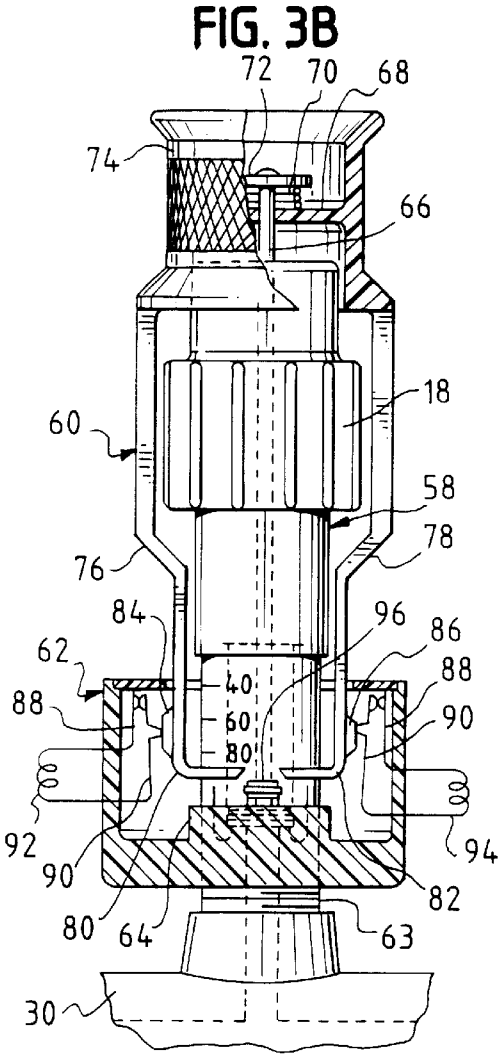
Figure 3A:
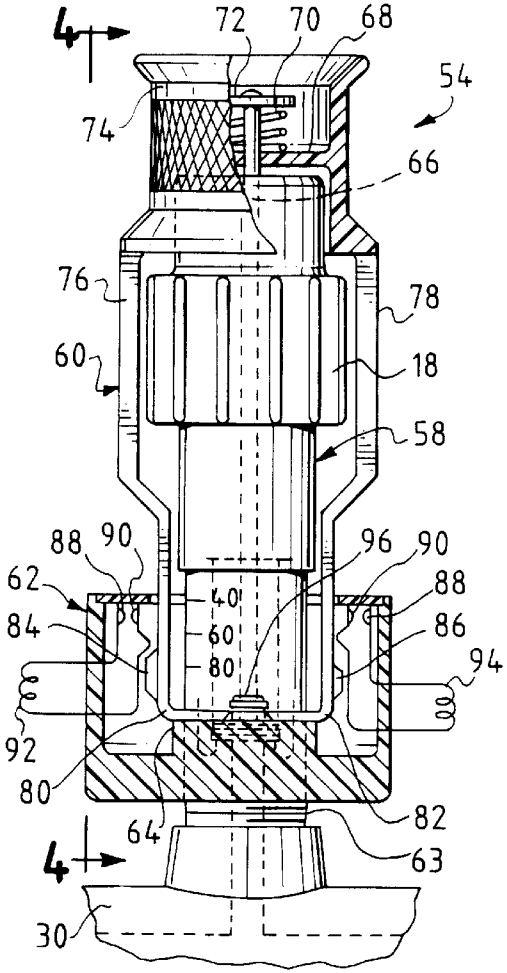

Referring to FIGS. 3A–3C, component 54 includes an adjustable relief valve 58, a moveable actuator 60, and a guide member 62. As shown in FIGS. 3A–3C, valve 58 includes the knob 18 and the structure related thereto that is shown in FIG. 1 which allows a user to select a desired pressure to be placed in an containing chamber such as, for example, an air storage tank. The lower, central portion 64 of the guide member 62 is attached to or integral with the outer peripheral surface of valve 58 as shown. Valve 58 is connected to the outlet 63 of tank 30 and has an elongated valve stem 66 connected to stem 26 (FIG. 1) which extends through an aperture in the horizontal wall 68 of the moveable actuator 60. Spring 70 surrounds the elongated portion 66 of the valve stem 26 beneath cap 72 and urges the moveable actuator 60 downward towards tank 30.

Moveable actuator 60 includes a cylindrical handle portion 74 which is integral with the horizontal wall 68 and two downwardly extending resilient fingers 76 and 78. Fingers 76 and 78 include horizontal members 80 and 82 and have an aperture therebetween for allowing a user to change the pressure setting on relief valve 58 by the rotation of knob 18 as discussed with reference to FIG. 1. Cam members 84 and 86 are mounted on fingers 76 and 78.

Figure 4:
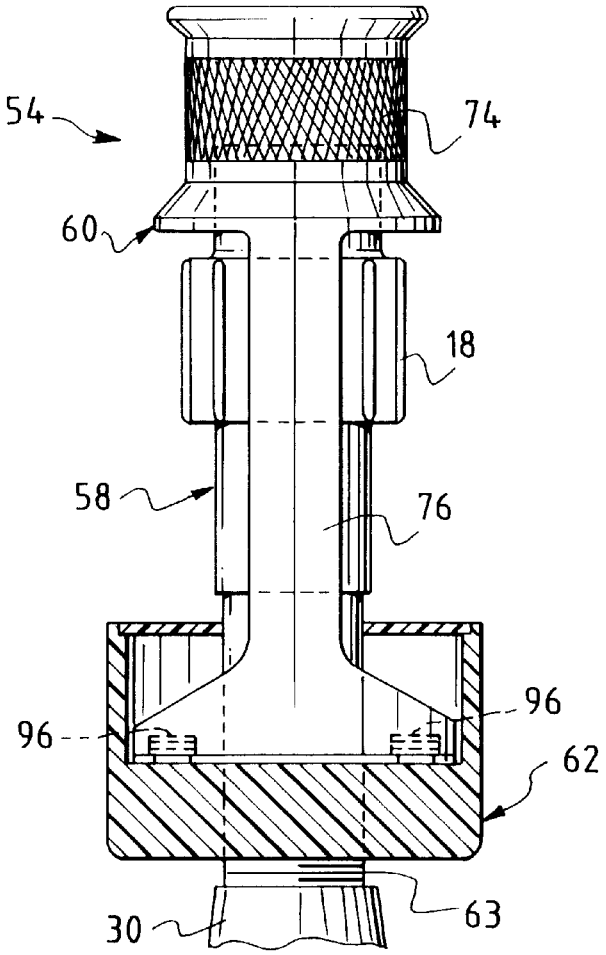
FIG. 4 is a sectional view taken along lines 4—4 in FIG. 3A.

Guide member 62 includes an aperture for receiving the resilient fingers 76 and 78 and the body portion 14 (FIG. 1) of the relief valve 58. Guide member 62 supports two switches each of which comprises a leaf contact 88 and a spring contact 90. The spring contacts 90 cooperate with the cam members 84 and 86 to close the switches as shown in FIGS. 3A–3C. The horizontal members 80 and 82 engage two snaps 96 that are provided on guide member 62 as shown in FIG. 4.

The actuator 62 is moveable between the first, second, and third positions shown in FIGS. 3A–3C, respectively, which allows a user to control the application of power to the motor windings 92 and 94 and the state of relief valve 58. When actuator 62 is disposed in the first position shown in FIG. 3A, no power is applied to the primary winding 92 or the start winding 94 because the switches are open and valve 58 is closed. When the actuator is moved to the position shown in FIG. 3B, the spring contacts 90 engage the leaf contacts 88 to apply power from an external source (not shown) to the windings 92 and 94. Also, the relief valve 58 is opened because the actuator 60 and spring 70 cause the valve stems 66 and 26 (FIG. 1) to break contact with inlet 63 and allow the high pressure air that is supplied to the tank 30 from compressor 44 to vent to atmosphere. Thus, no load is applied to the motor 42 during the time that it takes for the motor 42 to reach full speed, this time being typically on the order of one-quarter to one-half of a second. After the motor has reached full speed, the actuator can be released and moved to the position shown in FIG. 3C which deenergizes start winding 94 and allows the tank 30 to be filled to a user selected pressure.

When the tank reaches the user selected pressure indicated by the position of flange 20 (FIG. 1) with respect to body portion 14 (FIG. 1), the relief valve 58 opens and creates a hissing sound due to the escape of pressurized air to the atmosphere. This action indicates to the user that the actuator 60 should be moved back to the position shown in FIG. 3A which deenergizes the windings 92 and 94, shuts the motor 42 off as discussed above and closes valve 58 at the user-selected pressure.

Figure 5:
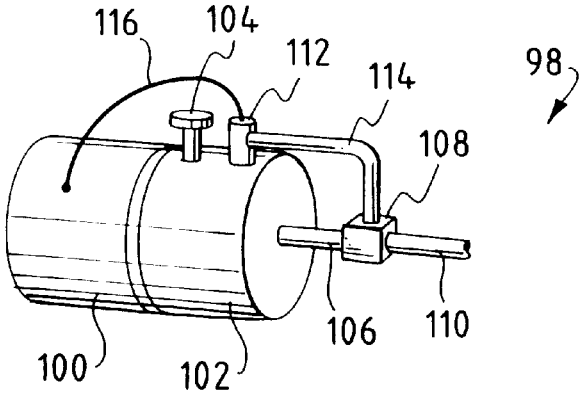
FIG. 5 is a perspective view of a portable air compressor system according to a second embodiment of the invention.

Referring to FIG. 5, a perspective view of a portable air compressor system according to a second embodiment of the invention is illustrated. Air compressor system 98 includes an electric motor 100 which is operatively engaged with an air compressor 102 via a motor shaft (not shown). Compressor 102 includes an air intake 104 and an outlet conduit 106 which communicates with a three-way check valve 108. Check valve 108 may be connected to an air containing chamber such as, for example, a pneumatic vehicle tire (not shown) via conduit 110 and communicates with a multi-use component 112 via conduit 114. Valve 108 precludes the flow of high pressure air from the component 112 or air containing chamber (not shown) back to compressor 102. Component 112 is electrically connected to the motor 100 via line 116 and allows a user to control the energization of the primary and start windings of the compressor motor and the state of an adjustable relief valve as discussed with reference to FIGS. 3A–3C.

While the invention has been illustrated and described in detail in the drawings and foregoing description, the same is considered as illustrative and not restrictive in character, it being understood that all changes and modification that come within the spirit of the invention are desired to be protected.

We claim:

1. An air compressor system for supplying compressed air to an air containing chamber, said system comprising:

an electric motor having primary and start windings;

an air compressor to be connected to the air containing chamber for supplying compressed air thereto, said compressor being operatively engaged with said motor, a valve to be connected to the air containing chamber and communicating with said air compressor, said valve being biased to a closed state and being moveable to an open state when a predetermined pressure in the air containing chamber is achieved; and an actuator operatively mechanically coupled to said valve, said actuator being moveable between first, second and third positions with respect to said valve to allow a user to control the energization of said windings and the state of said valve and thereby fill the air containing chamber up to the desired pressure by a method comprising the steps of (1) moving said actuator to a second position to cause both of said windings to be energized and said pressure relief valve to be opened thereby venting the air containing chamber to atmosphere, (2) subsequently moving said actuator to a third position to cause said primary winding to be energized, said start winding to be deenergized, and said valve to be closed thereby allowing the air compressor to supply compressed air to the air containing chamber, and (3) thereafter moving said actuator to a first position to cause both of said windings to be deenergized and to close said valve when the desired pressure in the air containing chamber is achieved.

2. The air compressor system of claim 1 wherein said valve further comprises means for adjusting the predetermined pressure to a user-selected value.

3. The air compressor system of claim 1 wherein said actuator further comprises means for holding said actuator in said first and third positions without the application of force and for holding said actuator in said second position only when force is applied to the actuator.

4. The air compressor system of claim 3 wherein said holding means comprises at least one resilient finger located on said actuator which engages at least one snap disposed on said valve.

5. The air compressor system of claim 3 wherein said holding means comprises at least one resilient finger located on said valve which engages at least one snap located on said actuator.

6. An air compressor system, comprising:

an air containing chamber;

electric motor having primary and start windings mounted on said air containing chamber;

an air compressor operatively engaged with said air containing chamber for supplying compressed air thereto;

a valve connected to said air containing chamber and communicating with said air compressor, said valve being biased to a closed state and being moveable to an open state when a predetermined pressure in said air containing chamber is achieved; and an actuator operatively mechanically coupled to said valve, said actuator being moveable between first, second and third positions with respect to said valve to allow a user to control the energization of said windings and the state of said valve and thereby fill the air containing chamber up to the desired pressure by a method comprising the steps of (1) moving said actuator to a second position to cause both of said windings to be energized and said pressure relief valve to be opened thereby venting the air containing chamber to atmosphere, (2) subsequently moving said actuator to a third position to cause said primary winding to be energized, said start winding to be deenergized, and said valve to be closed thereby allowing the air compressor to supply compressed air to the air containing chamber, and (3) subsequently moving said actuator to a first position to cause both of said windings to be deenergized and to close said valve when the desired pressure in the air containing chamber is achieved.

7. The air compressor system of claim 6 wherein said valve further comprises means for adjusting the predetermined pressure to a user-selected value.

8. The air compressor system of claim 6 wherein said actuator further comprises means for holding set actuator in said first and third positions without the application of force and holding said actor in said second position only when force is applied to the actuator.

9. The air compressor system of claim 8 wherein said holding means comprises at least one resilient finger located on said actuator which engages at least one snap disposed on said valve.

10. The air compressor system of claim 8 wherein said holding means comprises at least one resilient finger located on said valve which engages at least one snap located on said actuator.

11. An air compressor system for supplying compressed air to an air containing chamber, said system comprising:

an electric motor having primary and start windings;

an air compressor to be connected to the air containing chamber for supplying compressed air thereto, said compressor being operatively engaged with said motor;

a valve to be connected to the air containing chamber and communicating with said air compressor, said valve being biased to a closed state and being moveable to an open state when a predetermined pressure in the air containing chamber is achieved; and an actuator operatively mechanically coupled to said valve, said actuator being moveable between first, second and third positions with respect to said valve to allow a user to control the energization of said windings and the state of said valve and thereby fill the air containing chamber up to the desired pressure, wherein (1) both of said windings are energized and said pressure relief valve is opened to vent the air containing chamber to atmosphere when said actuator is disposed in said second position, (2) said primary winding is energized, said start winding is deenergized, and said valve is closed to supply compressed air from said air compressor to the air containing chamber when said actuator is disposed in said third position, and (3) both of said windings are deenergized and said valve is closed to stop said air compressor from supplying compressed air to the air containing chamber when said actuator is disposed in said first position.

12. The air compressor system of claim 11 wherein said valve further comprises an adjustable member, movement of said adjustable member with respect to said valve causing the predetermined pressure to be adjusted to a user-selected value.

13. The air compressor system of claim 11 wherein said actuator fiber comprises a coupling operatively engaged therewith, said coupling allowing said actuator to be disposed in said first and third positions without the application of force and further allowing said actuator to be disposed in said second position only when force is applied to the actuator.

14. The air compressor system of claim 13 wherein said coupling comprises at least one resilient finger located on said actuator which engages at last one snap disposed on said valve.

15. The air compressor system of claim 13 wherein said coupling comprises at least one resilient finger located on said valve which engages at least one snap located on said actuator.

* * * * *